United States Patent [19]

Miyagawa et al.

[11] Patent Number: 4,863,526

[45] Date of Patent: Sep. 5, 1989

[54] FINE CRYSTALLINE THIN WIRE OF COBALT BASE ALLOY AND PROCESS FOR PRODUCING THE SAME

[75] Inventors: Yukio Miyagawa; Zenzo Kitayama; Ikuo Ishiguro; Yoshimasa Suzuki, all of Kanagawa, Japan

[73] Assignee: Pilot Man-Nen-Hitsu Kabushiki Kaisha, Tokyo, Japan

[21] Appl. No.: 71,834

[22] Filed: Jul. 10, 1987

[30] Foreign Application Priority Data

Jul. 11, 1986 [JP] Japan ..... 61-163126
Jun. 24, 1987 [JP] Japan ..... 62-157212

[51] Int. Cl.[4] ..... C22F 1/10

[52] U.S. Cl. ..... 148/3; 148/13; 148/425; 420/435; 420/436; 420/439

[58] Field of Search ..... 148/425, 3, 11.5 N, 148/13; 420/435–440

[56] References Cited

U.S. PATENT DOCUMENTS 4,297,135 10/1981 Giessen et al. ..... 75/123
4,365,994 12/1982 Ray ..... 75/123

*Primary Examiner*—R. Dean
*Attorney, Agent, or Firm*—Sughrue, Mion, Zinn, Macpeak and Seas

[57] ABSTRACT

A fine crystalline thin wire of a cobalt base alloy having a composition of the formula;

CokMlBmSin where Co is cobalt; M is at least one of the transition metals of groups IV, V and VI of the periodic table; B is boron; Si is silicon; K, l, m and n represent atom percent of Co, M, B and Si, respectively, and have the following values:

k=40–78 l=10–50 m=2–15 n=8–20 and the fine crystal grains in the thin wire having an average size of no more than 5 μm.

A process for producing a fine crystalline thin wire of cobalt base alloy which comprises thermally melting an alloy having a composition of the formula:

CokMlBmSin where Co is cobalt; M is at least one of the transition metals of groups IV, V and VI of the periodic table; B is boron; Si is silicon; k, l, m and n represent atom percent of Co, M, B and Si, respectively, and have the following values:

k=40–78 l=10–50 m=2–15 n=8–20 and subsequently jetting the molten alloy through a spinning nozzle while rapidly quenching the spun filaments to solidify at a cooling rate of $10^4$–$10^6$ K/sec so that a thin wire having crystal grains of no more than 5 μm in average size will be formed in one stage.

13 Claims, 1 Drawing Sheet

FINE CRYSTALLINE THIN WIRE OF COBALT BASE ALLOY AND PROCESS FOR PRODUCING THE SAME

BACKGROUND OF THE INVENTION

The present invention relates to a fine crystalline thin wire of cobalt base alloy having improved resistance to wear, bending and corrosion, as well as to a process for producing such a wire.

Thin metal wires in extensive use as industrial materials include stainless steel wires, piano wires, Elgiloy alloy wires, powder-high speed steel wires and hard metal wires. However, stainless steel wires, piano wires and Elgiloy alloy wires are low in wear resistance, powder-high speed steel wires do not have high corrosion resistance, and hard metal wires are poor in resistance to bending and corrosion. These prior art thin wires are typically manufactured by powder metallurgical techniques and wire drawing methods but these methods of production require complicated steps which have to be carried out with expensive equipment and the cost of the final products is inevitably high.

Boron-containing transition metal alloys having improved strength, hardness and corrosion resistance and a process for producing filaments of these alloys have been proposed (U.S. Pat. No. 4,365.994). The proposed method consists basically of making an amorphous filament by the melt spinning of an alloy with a specified composition and subsequently heat-treating the filament to produce a high-strength filament in which uniformly dispersed ultrafine grains of a crystal phase have developed. In order to avoid brittleness due to the pressence of excessive silicon, the proposed process incorporates either no silicon at all or only a small amount, so that the filament produced is low in wear resistance and the alloy does not have good spinnability. In addition, the alloy which contains iron is low in corrosion resistance and does not ensure completely satisfactory wear resistance. Furthermore, the alloy contains nickel and does not have adequate spinnability. A further problems is that a molten metal must be first spun into amorphous alloy before a heat treatment is conducted and high-strength filaments can be attained only when these steps, which make the production process complicated, are taken.

As will be understood from the above, none of the existing thin metal wires satisfy the requirements for high resistance to wear, bending and corrosion, nor has a process been known by which thin metal wires having these characteristics can be produced in an efficient and economical manner.

As a result of continued efforts to deal with such situations, the present inventors discovered inexpensive and novel alloy compositions having improved spinnability and a high tendency to produce fine crystal grains. Based on this finding, the present inventors have succeeded in developing thin metal wires having improved resistance to wear, bending and corrosion, as well as an economical process for producing such thin wires.

SUMMARY OF THE INVENTION

In one aspect, the present invention provides a fine crystalline thin wire of a cobalt base alloy having a composition of the formula:

$$Co_kM_lB_mSi_n$$

where Co is cobalt; M is at least one of the transition metals of group IV, V and VI of the periodic table; B is boron; Si is silicon; k, l, m and n represent atom percent of Co, M, B and Si, respectively, and have the following values:

$k=40-78$ $l=10-50$ $m=2-15$ $n=8-20$ and the fine crystal grains in the thin wire have an average size of no more than 5 μm.

The present invention also provides a fine crystalline thin wire of a cobalt base alloy having a composition of the formula:

$$Co_kM_lB_mSi_nR_x$$

where Co is cobalt; M is at least one of the transition metals of groups IV, V and VI of the periodic table; B is boron; Si is silicon; R is at least one rare earth metal; k, l, m, n and x represent atom percent of Co, M, B, Si and R, respectively, and have the following values:

$k=40-78$ $l=10-50$ $m=2-15$ $n=8-20$ $x=0.001-0.5$ and the fine crystal grains in the thin wire have an average size of no more than 5 μm.

The present invention also provides a fine crystalline thin wire of a cobalt base alloy having a composition of the formula;

$$Co_kM_lB_mSi_nC_y$$

where Co is cobalt; M is at least one of the transition metals of groups IV, V and VI of the periodic table; B is boron; Si is silicon; C is carbon; k, l, m, n and y represent atom percent of Co, M, B, Si and C, respectively, and have the following values:

$k=40-78$ $l=10-50$ $m=2-15$ $n=8-20$ $y=0.1-5.0$ and the fine crystal grains in the thin wire have an average size of no more than 5 μm.

The present invention also provides a fine crystalline thin wire of a cobalt alloy having a composition of the formula:

$$Co_kM_lB_mSi_nR_xC_y$$

where Co is cobalt; M is at least one of the transition metals of groups IV, V and VI of the periodic table; B is boron; Si is silicon; R is at least one rare earth metal; C is carbon k, l, m, n and y represent atom percent of Co, M, B, Si, R and C, respectively, and have the following values:

k=40–78 l=10–50 m=2–15 n=8–20 x=0.001–0.5 y=0.1–5.0 and the fine crystal grains in the thin wire have an average size of no more than 5 μm.

In another aspect, the present invention provides a process for producing a fine crystalline thin wire of a cobalt base alloys which comprises thermally melting an alloy having a composition of the formula:

(a) $Co_kM_lB_mSi_n$ (b) $Co_kM_lB_mSi_nR_x$ (c) $Co_kM_lB_mSi_nC_y$ (d) $Co_kM_lB_mSi_nR_xC_y$ *where Co is cobalt; M is at least one of the transition metals of groups IV, V and VI of the periodic table; B is boron; Si is silicon; R is at least one rare earth metal; C is carbon; k, l, m, n, x and y represent atom percent of Co, M, B, Si, R and C, respectively, and have the following values:* k=40–78 l=10–50 m=2–15 n=8–20 x=0.001–0.5 y=0.1–5.0 and subsequently jetting the molten alloy through a spinning nozzle while rapidly quenching the spun filaments to solidify at a cooling rate of $10^4$–$10^6$ K./sec so that a thin wire having crystal grains of no more than 5 μm in average size will be formed in one stage.

The present invention also provides a process for producing a fine crystalline thin wire of a cobalt base alloy which comprises thermally melting an alloy having a composition of the formula:

(a) $Co_kM_lB_mSi_n$ (b) $Co_kM_lB_mSi_nR_x$ (c) $Co_kM_lB_mSi_nC_y$ (d) $Co_kM_lB_mSi_nR_xC_y$ *where Co is cobalt; M is at least one of the transition metals of groups IV, V and VI of the periodic table; B is boron; Si is silicon; R is at least one rare earth metal; C is carbon; k, l, m, n, x and y represent atom percent of Co, M, B, Si, R and C, respectively, and have the following values:* k=40–78 l=10–50 m=2–15 n=8–20 x=0.001–0.5 y=0.1-5.0 subsequently jetting the molten alloy through a spinning nozzle while rapidly quenching the spun filaments to solidify at a cooling rate of $10^4$–$10^6$ K./sec so as to form a thin wire having crystal grains of no more than 5 μm in average size, and thereafter heat-treating said thin wire at a temperature in the range of 800–1,600 K.

DETAILED DESCRIPTION OF THE PREFERRED EMBODIMENTS

Figure 1:
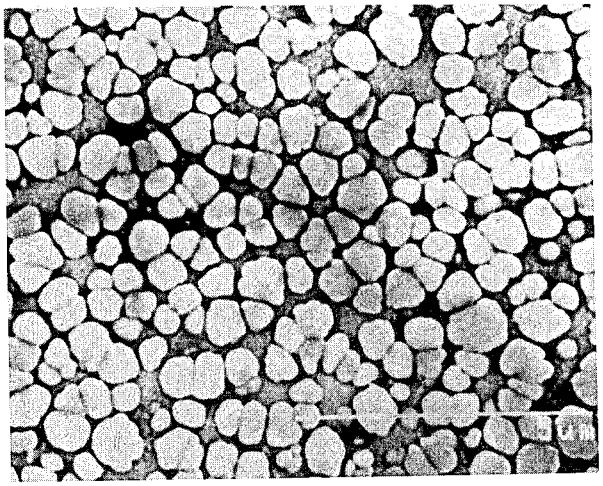
FIG. 1 is a micrograph showing the microcrystalline structure of a thin metal wire of a $Co_{58}Cr_{10}W_5Mo_5B_{12}Si_{10}$ alloy.

In the fine crystalline thin wire of cobalt base alloy of the present invention and the process for producing the same, the compositional ranges of the respective components are limited as specified in the preceding paragraphs for the following reason.

(a) Co

Cobalt has fairly good spinnability in melt spinning by the rapid quenching method. Besides its comparatively high corrosion resistance, cobalt also satisfies other performance requirements in such respects as resistance to bending and wear and hardness. Therefore, cobalt is the only metal that can be used as the base metal in the alloy composition of the intended thin metal wire. Cobalt is incorporated in the alloy composition in an amount of 40–78 at%, preferably 50–70 at%. If the cobalt content is less than 40 at%, the alloy composition has low spinnability and reduced resistance to bending. Therefore, cobalt should be incorporated in an amount of at least 40 at%. On the other hand, cobalt should not be incorporated in an amount exceeding 78 at% in order to avoid a decrease in wear resistance and hardness.

(b) Si

Silicon is an alloying component that has the greatest effect on spinnability in melt spinning by rapid quenching and solidification and the present inventors have found that a long continuous thin metal wire of good quality can be attained only when silicon is incorporated in an amount exceeding a certain value. In order to attain the desired thin wire, at least 8 at% silicon must be incorporated in the alloy. If the silicon content is less than 8 at%, a long continuous thin metal wire of good quality cannot be attained an only short or beaded wires will result. In an extreme case, small spheres will form.

Therefore, silicon should be incorporated in an amount of at least 8 at%. As the silicon content increases, the spinnability of the alloy is progressively improved but the effect of silicon is substantially saturated at a level of about 20 at%. The present inventors have found that in addition to its effect in improving spinnability, silicon serves to provide improved wear resistance. In order to attain the high wear resistance intended by the present invention, it is imperative that silicon be incorporated in the alloy in an amount of at least 8 at% and the present inventors have found that an alloy having less than 8 at% Si is low in wear resistance. According to the present invention, melt spinning by rapid quenching and solidification is conducted to produce a fine-grained crystalline structure so that thin metal wires having improved resistance to bending can be attained. For this purpose, it is most important to design an alloy composition that will easily become fine-grained upon rapid quenching.

The present inventors have found that there exists an optimum range for the amount of silicon that needs to be incorporated in the alloy to create a fine-grained crystal structure. If the silicon content of the alloys is less than 8 at%, the alloy will produce a dendritic structure and have reduced resistance to bending. In the range of 8–12 at%, thin metal wires that have crystal grains no larger than 2 μm and which hence have great resistance to bending can be produced. Beyond 12 at%, the crystal grains have a tendency to grow, although gradually, to sizes of 5 μm and below. If the silicon content exceeds 20 at%, the growth of coarse grains is accelerated and the alloy will become extremely brittle.

Therefore, in order to attain good resistance to bending, the silicon content of the alloy should be in the range of 8–20 at%, preferably 8–12 at%. The silicon content also influences that corrosion resistance of the alloy. The present inventors have found that the alloy is comparable or superior to stainless steel in terms of corrosion resistance if it contains 8–20 at% silicon.

The alloy of the present invention contains a fairly large amount of silicon and yet retains high resistance to bending. This is because silicon is incorporated in the Co base which is free from Fe or Ni so that the crystalline structure of the alloy will have a uniform and ultra-fine-grained supersaturated solid solution or dual-phase solid solution that is free from coarse grain boundary precipitates which would promote its brittleness.

As described above, the silicon content has large effects on each of the performance characteristics of the alloy under consideration, viz., spinnability, wear resistance, bending resistance and corrosion resistance. To attain a good overall balance between these properties, the range of 8–20 at% is effective and the range of 8–12 at% is most effective.

(c) Transition metals of groups IV, V and VI of the periodic table

This component forms a boride with boron and forms a silicide with silicon, both elements being present in the alloy composition; the effect is to enhance the hardness of a thin wire. In addition, this component serves to provide enhanced wear resistance. For these reason, transition metals of groups IV, V and VI of the periodic table are absolutely indispensable alloying components. The "transition metals of groups IV, V and VI" as used in the present invention are titanium (Ti), zirconium (Zr), hafnium (Hf), vanadium (V), niobium (Nb), tantalum (Ta), chromium (Cr), molybdenum (Mo) and tungsten (W). These transition metals may be incorporated either independently or in combination.

If they are incorporated in combination the maximum content of each component is preferably no more than 20 at%, provided that Mo may be added up to 40 at%.

The overall content of the transition metals is within the range of 10–50 at%, preferably in the range of 15–40 at%. If the content of a transition metal of group IV, V and VI in the thin metal wire is less than 10 at%, it does not exhibit any significant effect in improving the wear resistance of the wire. Its effect becomes pronounced if the transition metal is contained in an amount of 10 at% and more but if its content exceeds 50 at%, the toughness of the alloy will be impaired to produce a thin wire having low resistance to bending.

If titanium, vanadium and/or chromium are specifically used as transition metals, one or more of these elements are preferably incorporated in a total amount not exceeding 20 at%; otherwise, the spinnability of the alloy will be impaired.

(d) B

Boron forms a boride with a transition metal of group IV, V and VI, thereby enhancing not only the hardness but also the wear resistance of a thin wire. Furthermore, if boron is incorporated in an amount exceeding a certain value, its grain refining effect will materialize to provide a thin metal wire with improved resistance to bending.

If the content of boron in the alloy is less than 2 at%, it will have a dendritic structure and the resulting thin metal wire will have impaired toughness and low resistance to bending. In the range of 2–15 at% B, fine crystal grains not larger than 5 μm will form to provide a thin metal wire having high resistance to bending. The range of 2–12 at% B is particularly advantageous because the generation of crystal grains not larger than 2 μm is ensured in this range. If the boron content exceeds 15 at%, sufficient toughness is not attained to provide high resistance to bending. Therefore, boron is incorporated in the thin metal wire of the present invention is an amount of 2–15 at%, preferably 5–12 at%.

While the components (a), (b), (c) and (d) of the thin metal wire of the present invention have been discussed in the foregoing paragraphs, it should be particularly mentioned that if titanium, vanadium and/or chrominum are specifically used as transition metals, incorporating one or more of these elements and cobalt in a total amount not exceeding 80 at% and incorporating boron and silicon in a total amount of 10–35 at%, preferably 13–35 at%, is preferable for the purpose of providing a thin Co base alloy wire having the desired high wear resistance.

(e) Rare earth metal

The present inventors have found that if a minor amount of this component is incorporated in the above described Co-M-B-Si alloy, the crystal grains in the structure of this alloy become even finer to provide a further improvement in its resistance to bending. The "rare earth metals" are used in the present invention are scandium (Sc) and yttrium(Y) with respective atomic numbers 21 and 39 in the periodic table, as well as the metals with atomic numbers 57 to 71, i.e., lanthanum (La), cerium (Ce), praseodymium (Pr), neodymium (Nd), promethium (Pm), samarium (Sm), europium (Eu), gadolinium (Gd), terbium (Tb), dysprosium (Dy), holmium (Ho), erbium (Er), thulium (Tm), ytterbium (Yb) and lutetium (Lu).

These rare earth metals may be incorporated either individually or in combination. If the content of a rare earth metal in the alloy is less than 0.001 at%, it is substantially in slightly effective in further refining the crystal grains in the alloy. If the content of the rare earth metal is 0.001 at% or more, the crystal grains in the alloy become smaller and in the range of 0.001–0.5 at%, uniform fine grains no larger than 2 μm will form to provide the alloy with a very high resistance to bending. However, if the content of the rare earth metal exceeds 0.5 at%, not only is the effect of refining crystal grains lost but also the resistance of the alloy to bending is impaired. Therefore, it is very effective for the purposes of the present invention to incorporate the rare earth metal in an amount of 0.001–0.5 at%.

(f) C

This component serves to further improve the wear resistance of the alloy. This would be because the transition metal in the alloy forms a hard carbide with carbon to be dispersed as fine grains in the alloy. Therefore, carbon is incorporated if high wear resistance is specifically needed. Carbon contained in an amount of less than 0.1 at% is only slightly effective in providing improved wear resistance but a very high wear resistance is attained in the range of 0.1–5 at%. In this case, the total content of boron, silicon and carbon is preferably in the range of 10–40 at%, with the range of 13–35 at% being optimum.

The thin cobalt base alloy wire of the present invention having the compositional ranges described in the foregoing pages has a fine crystalline structure in which crystal grains having an average size of no more than 5 μm are precipitated an uniformly dispersed in the matrix phase having an average grain size of no more than 5 μm, with none of the crystal grains exceeding 5 μm in size. Because of this fine crystalline structure, the thin cobalt base alloy wire of the present invention exhibits a very high resistance to bending. This property will materialize if the size of crystal grains is 5 μm and below and the smaller the grains, the better. If the grain size is 2 μm and below, the thin wire will not easily break even if it is bent at a small radius.

Exemplary compositions of the fine crystalline thin wire of cobalt base alloy according to the present invention are listed below:

Co-W-B-Si,
Co-Mo-B-Si,
Co-Cr-Mo-B-Si,
Co-Ta-Mo-B-Si,
Co-Nb-Zr-B-Si,
Co-Mo-V-B-Si-C,
Co-Ti-V-B-Si-C,
Co-Cr-W-Hf-B-Si-Nd,
Co-Cr-W-Mo-B-Si-Ce-Dy,
Co-Cr-W-Zr-B-Si-Ce-Sc,
Co-Cr-W-Mo-B-Si-Y,
Co-Cr-W-Ta-B-Si-La,
Co-Cr-W-Nb-B-Si-Tb,
Co-Cr-Mo-V-B-Si-Ho,
Co-W-Ta-Ti-B-Si-Pr-Yb,
Co-W-Mo-Hf-B-Si-Cd,
Co-Mo-Nb-Ta-B-Si-Sm.

The method of producing the fine crystalline thin wire of cobalt base alloy of the present invention is hereunder described in greater detail. The method employed in the present invention is not notably different from the conventional melting spinning method. The present inventors have found that when an alloy having the already described composition is thermally melted and jetted with great force through a slotted nozzle, followed by rapid quenching and solidification at a predetermined cooling rate, thin wires having fine crystal grains no larger than 5 μm can be produced.

The in-rotating-liquid spinning method in which the molten metal is jetted into a fluid is an advantageous technique for achieving melt spinning in that it is capable of uniform quenching and solidification of metal into a thin wire form. In the in-rotating-liquid spinning method, a molten metal is jetted into a liquid layer formed in a rotating drum by centrifugal force and the metal is solidified into a thin metal wire form. Although this in-rotating-liquid spinning method is best, other techniques may be employed such as, for example, spinning by jetting a molten metal onto a rotating single roll or between two rotating rolls, spinning by jetting the melt onto both inner and outer surfaces of a rotating drum, and spinning by jetting the melt into a liquid stream.

Whichever method of melt spinning is employed, it is absolutely necessary that the molten alloy be rapidly quenched and solidified at a cooling rate in the range of $10^4$–$10^6$ K./sec. If the cooling rate is less than $10^4$ K./sec, crystal grains larger than 5 μm will form to produce thin wires that are brittle and easy to break. If the cooling rate exceeds $10^6$ K./sec, an amorphous phase will develop in thin wires to make them less resistant to wear and heat. In order to attain the desired fine crystalline thin wires, the melt has to be extruded in the optimum melting temperature range of the alloy, which will vary with the alloy composition but is generally in the range of temperature higher than the melting point of the alloy used (1,300–1,800 K.) by about 50–300 K. At temperatures slightly higher than the melting point of the alloy, the melt is too viscous to be jetted smoothly so that consistent production of continuous thin wires can not be attained. If the temperature of the melt is more than 300 K. higher than the melting point of the alloy, the viscosity is too low to produce a stable jet and rapid oxidation, will occur.

The cross-sectional shape and dimensions of the thin wire produced vary in accordance with the form of the nozzle. If the nozzle has a circular cross section, thin wires having a circular cross section will be produced and if the nozzle has a rectangular cross section, ribbons having a rectangular cross section will result. If the thickness of a ribbon (or the diameter of a round wire) exceeds 0.7 mm, it becomes difficult to attain a cooling rate of at least $10^4$ K./sec and coarse crystal grains will form to make the thin wire easily breakable.

The in-rotating-liquid spinning method and the method of spinning in which the molten metal is jetted into a liquid stream are suitable for producing thin wires having a circular cross section. Wires having a diameter of 0.1 mm or more are prone to become elliptical in cross section and this tendency increases as the wire becomes thicker. Thick wires also have a tendency to experience frequent troubles such as wire breaking during the spinning process. Comparatively thick round wires or uninterrupted long thin wires can be obtained by the in-rotating-liquid spinning method or the spinning method in which a molten metal is jetted into a liquid stream if the liquid serving as a cooling medium is composed of an aqueous solution containing weakly alkaline inorganic chemicals. The pH of this aqueous solution is in the range of from about 9 to about 13.

Useful weakly alkaline inorganic chemicals include tungstates, molybdates, silicates, phosphates and carbonates. These salts are used in amounts ranging from 5 to 50%. If the content of the weakly alkaline inorganic chemicals is less than 5%, elliptical wires will form and frequently break during spinning. If the content of the inorganic chemicals is 10% or more, wires that are nearest to a true circle in cross section can be attained in a consistent manner. If the inorganic chemicals is present in an amount of 40% or more, wires with a circular cross section can still be obtained but their circumference will become slightly uneven. If the content of the inorganic chemicals exceeds 50%, desired wires having a uniform thickness cannot be attained.

Therefore, in order to produce long uninterrupted thin wires of uniform thickness having a highly circular cross section, the weakly alkaline inorganic chemicals is preferably used in an amount of 10–40%. Of the weakly alkaline inorganic chemicals mentioned, a carbonate is most preferable.

The reasons why the advantages described above can be attained by making the liquid layer form an aqueous solution containing a weakly alkaline inorganic chemicals have not been fully unravelled but probably this chemicals would mitigate the effect of the dynamic pressure of the rotating liquid layer into which the molten metal is plunged while permitting the jetted molten metal to be cooled at an adequate rate.

The fine crystalline thin wire produced by the methods described above is entirely satisfactory in that it possesses the performance the present invention intends to attain. However, the present inventors have found that the resistance of this thin wire to wear and bending can be further improved if it is heated in a non-oxidizing atmosphere. When this thin wire is subjected to heat treatment at a temperature of 800–1,600 K. for a period of 5–500 minutes, the wire becomes more resistant to wear and gains some flexibility. The reason for this phenomenon is not completely clear but probably the internal strain that has developed in the fine crystalline structure as a result of rapid quenching and solidification would be relieved by heat treatment. This relaxation of internal strain is insufficient if the heating temperature is lower than 800 K., and undesirable coarse crystal grains will develop if the temperature exceeds 1,600 K. At least 5 minutes is required to achieve strain relaxation but if heat treatment is conducted longer than 500 minutes, overaging wil produce weak grain boundaries.

The following examples are provided for the purpose of further illustrating the present invention but are in no way to be taken as limiting.

EXAMPLE 1

An alloy composed of 68% Co, 10% Cr, 5% W, 5% Mo, 2% B and 10% Si (all percents are atom percent) was charged into a transparent quartz crucible that was filled with an argon plus 5% hydrogen atmosphere and which was equipped with a spinning nozzle having a diameter of about 0.25 mm. The charged alloy was melted at about 1,520 K. by high-frequency induction heating.

A stainless steel drum of inner diameter 500 mm containing water and having grooves 30 mm wide and 30 mm deep formed in its inner surface was rotated at 300 rpm to form a stationary water layer 25 mm deep in the grooves. The molten alloy was jetted into the stationary water layer at an incident angle of 45 degrees and at a pressure of about 3 kg/cm$^2$ through the spinning nozzle which was located 3 mm away from the surface of the stationary water layer. The jetted molten metal was rapidly quenched at $10^5$ K./sec to produce a continuous thin wire that had an almost circular cross section and which had a uniform diameter of 0.23 mm.

A cross section of the wire was polished, etched with a mixed solution of hydrochloric acid and hydrogen peroxide (20:1 in volume ratio) and observed with a scanning electron microscope (10,000X). The maximum diameters of the crystal grains averaged 0.8 $\mu$m, indicating an extreme uniformity in the dispersion of ultrafine grains.

In Examples 2–49 in addition to Example 1, thin metal wires were also prepared that had compositions and crystal grain sizes within the scope of the present invention. By way of comparison, experimental thin wires that were outside the scope of the present invention in terms of alloy composition and crystal grain size were prepared (Comparative Examples 1–11). These thin metal wires, as well as a conventional stainless wire, piano wire, Elgiloy alloy wire, powder-high speed steel wire and hard metal wire were subjected to tests for wear, deflective strength, corrosion current and hardness. the results of wire production are summarized in Table 1, and the results of performance tests together with crystal grain size data are shown in Table 2.

Figure 2:
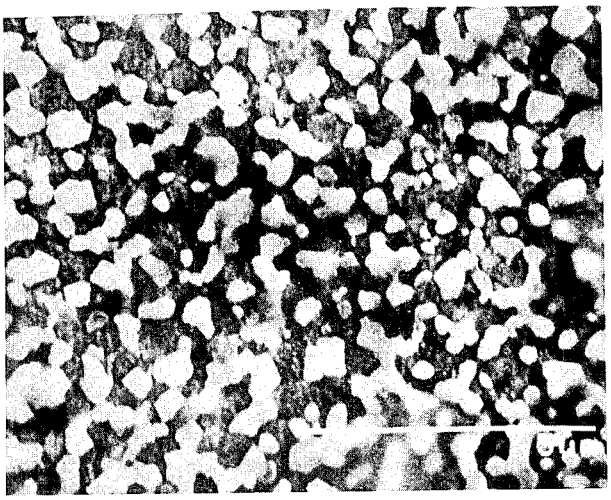
FIG. 2 is a micrograph showing the microcrystalline structure of a thin metal wire of a $Co_{64.95}Cr_{10}W_5Mo_5B_5Si_{10}Ce_{0.05}$ alloy, which was heat-treated at 1,273 K. for 1 hour.

Microphotographs showing the microcrystalline structures of the thin wires prepared in Examples 7 and 35 are reproduced in FIGS. 1 and 2, respectively.

Thin wires were produced in Examples 2–49 and Comparative Examples 1–11 as follows.

EXAMPLES 2–19

By repeating the procedures of Example 1, fine-grained continuous thin wires that had a cross section close to a true circle and which had uniform diameters in the range of 0.2–0.25 mm were produced.

EXAMPLES 20–46

By repeating the procedures of Example 1, fine-grained continuous thin wires that had a cross section close to a true circle and which had uniform diameters in the range of 0.2–0.25 mm were produced. These wires were subsequently heat-treated under the conditions shown in Table 1.

EXAMPLE 47

An alloy having the composition indicated in Table 1 was charged into a transparent quartz crucible that was filled with an argon plus 5% hydrogen atmopshere and which was equipped with a spinning nozzle having a diameter 0.5 mm. The charged alloy was melted by high-frequency induction heating. Two horizontal stainless steel rolls of outer diameter 100 mm, each having a semicircular groove (0.3 mm$\phi$) formed in its peripheral surface in an area that faced the other roll, were arranged side by side in such a way that a circular gap with a diameter of about 0.3 mm would form between the surfaces of the rolls when they contacted each other. As the rolls were rotated at 1,000 rpm, the molten alloy was jetted toward the gap between the rolls through the spinning nozzle at a pressure of about 0.5 kg/cm$^2$ so as to produce a continuous thin wire that had a circular cross section and a uniform diameter of 0.25 mm.

EXAMPLE 48

An alloy composed of 58% Co, 10% Cr, 5% W, 5% Mo, 12% B and 10% Si (all percents are atom percent) was charged into a transparent quartz crucible that was filled with an argon plus 5% hydrogen atmosphere and which was equipped with a spinning nozzle having a diameter of about 0.27 mm. The charged alloy was melted at about 1,520 K. by high-frequency induction heating.

A stainless steel drum of inner diameter 500 mm containing an aqueous alkaline solution of 10% carbonate and having grooves 30 mm wide and 30 mm deep formed in its inner surface was rotated at 280 rpm to form a stationary aqueous layer 28 mm deep in the grooves. The molten alloy was jetted into the stationary aqueous layer (303 K.) at an incident angle of 59 degrees and at a pressure of about 2.5 kg/cm$^2$ through the spinning nozzle which was located 3 mm away from the surface of the stationary aqueous layer. The jetted molten metal was rapidly quenched to produce a uninterrupted and continuous thin wire that had a completely circular cross section and which had a uniform diameter of 0.25 mm. This wire was subsequently heat-treated at 1,273 K. for 1 hour.

EXAMPLE 49

A continuous uninterrupted thin wire having a completely circular cross section and a diameter of 0.27 mm was produced by repeating the procedures of Example 48 except that a stationary layer of an aqueous alkaline solution of 25% carbonate was formed in the rotating drum. The wire was subsequently heat-treated at 1.273 K. for 1 hour.

COMPARATIVE EXAMPLES 2-8, 10 AND 11

Alloys having the compositions shown in Table 1 were subjected to spinning and subsequently quenched to solidify as in Example 1.

COMPARATIVE EXAMPLES 1 AND 9

Alloys having the compositions shown in Table 1 were subjected to spinning and subsequently quenched to solidify as in Example 1. The resulting wires were then heat-treated under the conditions indicated in Table 1.

TABLE 1

| Example | alloy composition (atom %) | | | | | | | | | | | | | | State of Thin wire | Heat treatment K/hr |
|---|---|---|---|---|---|---|---|---|---|---|---|---|---|---|---|---|
| | Co | Cr | Ti | V | W | Mo | B | Si | Sc | Y | Ce | Dy | Er | C | | |
| 1 | 68 | 10 | — | — | 5 | 5 | 2 | 10 | — | — | — | — | — | — | uniform, long, and continuous thin wire | — |
| 2 | 73 | 5 | — | — | 5 | 5 | 2 | 10 | — | — | — | — | — | — | " | — |
| 3 | 77 | 1 | — | — | 5 | 5 | 2 | 10 | — | — | — | — | — | — | " | — |
| 4 | 70 | 1 | — | — | 5 | 5 | 2 | 17 | — | — | — | — | — | — | " | — |
| 5 | 67 | 10 | — | — | 5 | 5 | 5 | 8 | — | — | — | — | — | — | " | — |
| 6 | 74 | 1 | — | — | 5 | 5 | 5 | 10 | — | — | — | — | — | — | " | — |
| 7 | 58 | 10 | — | — | 5 | 5 | 12 | 10 | — | — | — | — | — | — | " | — |
| 8 | 68 | 5 | — | — | 5 | 5 | 2 | 15 | — | — | — | — | — | — | " | — |
| 9 | 60 | 10 | — | — | 5 | 5 | 5 | 15 | — | — | — | — | — | — | " | — |
| 10 | 65 | 5 | — | — | 5 | 5 | 5 | 15 | — | — | — | — | — | — | " | — |
| 11 | 67.995 | 10 | — | — | 5 | 5 | 2 | 10 | — | — | 0.005 | — | — | — | " | — |
| 12 | 67.99 | 10 | — | — | 5 | 2 | 2 | 10 | — | — | 0.01 | — | — | — | " | — |
| 13 | 72.95 | 5 | — | — | 5 | 5 | 2 | 10 | — | — | 0.05 | — | — | — | " | — |
| 14 | 64.95 | 10 | — | — | 5 | 5 | 5 | 10 | — | — | — | 0.05 | — | — | " | — |
| 15 | 64.95 | 10 | — | — | 5 | 5 | 5. | 10 | — | — | — | — | 0.05 | — | " | — |
| 16 | 76.5 | 1 | — | — | 5 | 5 | 2 | 10 | — | — | — | — | — | 0.5 | " | — |
| 17 | 74 | 1 | — | — | 5 | 5 | 2 | 10 | — | — | — | — | — | 3 | " | — |
| 18 | 73.95 | 1 | — | — | 5 | 5 | 2 | 10 | — | — | 0.05 | — | — | 3 | " | — |
| 19 | 69.95 | 5 | — | — | 5 | 5 | 2 | 10 | — | — | 0.05 | — | — | 3 | " | — |
| 20 | 67 | 10 | — | — | 5 | 5 | 5 | 8 | — | — | — | — | — | — | " | 1273 |
| 21 | 65 | 10 | — | — | 5 | 5 | 5 | 10 | — | — | — | — | — | — | " | 1173 |
| 22 | 56 | 10 | — | — | 5 | 5 | 12 | 12 | — | — | — | — | — | — | " | " |
| 23 | 65 | 10 | — | — | 5 | 5 | 5 | 10 | — | — | — | — | — | — | " | 1273 |
| 24 | 65 | 10 | — | — | 5 | 5 | 5 | 10 | — | — | — | — | — | — | " | 1373 |
| 25 | 74 | 1 | — | — | 5 | 5 | 5 | 10 | — | — | — | — | — | — | " | " |
| 26 | 73.8 | 1 | — | — | 5 | 5 | 5 | 10 | — | — | 0.2 | — | — | — | " | " |
| 27 | 70 | 5 | — | — | 5 | 5 | 5 | 10 | — | — | — | — | — | — | " | " |
| 28 | 55 | 20 | — | — | 5 | 5 | 5 | 10 | — | — | — | — | — | — | " | " |
| 29 | 45 | 20 | — | — | 10 | 10 | 5 | 10 | — | — | — | — | — | — | " | " |
| 30 | 68 | 5 | — | — | 5 | 5 | 2 | 15 | — | — | — | — | — | — | " | 1273 |
| 31 | 63 | 10 | — | — | 5 | 5 | 2 | 15 | — | — | — | — | — | — | " | " |
| 32 | 60 | 10 | — | — | 5 | 5 | 10 | 10 | — | — | — | — | — | — | " | 1373 |
| 33 | 58 | 10 | — | — | 5 | 5 | 12 | 10 | — | — | — | — | — | — | " | 1273 |
| 34 | 62 | 5 | — | — | 5 | 5 | 15 | 8 | — | — | — | — | — | — | " | 1373 |
| 35 | 64.95 | 10 | — | — | 5 | 5 | 5 | 10 | — | — | 0.05 | — | — | — | " | 1273 |
| 36 | 70 | 5 | — | — | 5 | 5 | 2 | 10 | — | — | — | — | — | 3 | " | 1373 |
| 37 | 57.95 | 10 | — | — | 5 | 5 | 12 | 10 | 0.05 | — | — | — | — | — | " | 1273 |
| 38 | 57.95 | 10 | — | — | 5 | 5 | 12 | 10 | — | 0.05 | — | — | — | — | " | " |
| 39 | 60 | 10 | 5 | — | 5 | 5 | 5 | 10 | — | — | — | — | — | — | " | 1373 |
| 40 | 65 | 5 | — | 5 | 5 | 5 | 5 | 10 | — | — | — | — | — | — | " | " |
| 41 | 68 | 10 | — | — | 5 | 5 | 2 | 10 | — | — | — | — | — | — | " | " |
| 42 | 65 | 10 | — | — | 5 | 5 | 2 | 10 | — | — | — | — | — | 3 | " | " |
| 43 | 65 | 5 | — | — | 5 | 5 | 5 | 15 | — | — | — | — | — | — | " | 1273 |
| 44 | 60 | 10 | — | — | 5 | 5 | 5 | 15 | — | — | — | — | — | — | " | " |
| 45 | 67 | 5 | — | — | 5 | 5 | 5 | 10 | — | — | — | — | — | 3 | " | 1373 |
| 46 | 62 | 10 | — | — | 5 | 5 | 5 | 10 | — | — | — | — | — | 3 | " | " |
| 47 | 73.95 | 1 | — | — | 5 | 5 | 5 | 10 | — | — | 0.05 | — | — | — | " | — |
| 48 | 58 | 10 | — | — | 5 | 5 | 12 | 10 | — | — | — | — | — | — | uniform, uninterrupted and continuous thin wire with true circular cross section | 1273 |
| 49 | 58.8 | 10 | — | — | 5 | 5 | 11 | 10 | — | 0.05 | — | — | — | 0.15 | " | " |

TABLE 1-continued

| Comparative Example | alloy composition (atom %) | | | | | | | | | | | | | | State of Thin Wire | Heat treatment K/hr |
|---|---|---|---|---|---|---|---|---|---|---|---|---|---|---|---|---|
| | Co | Cr | Ti | V | W | Mo | B | Si | Sc | Y | Ce | Dy | Er | C | | |
| 1 | 69 | 10 | — | — | 5 | 5 | 5 | 6 | — | — | — | — | — | — | short wire (≦5 cm) | 1173 |
| 2 | 67.5 | 10 | — | — | 5 | 5 | 5 | 7.5 | — | — | — | — | — | — | short wire of non-uniform thickness | — |
| 3 | 53 | 10 | — | — | 5 | 5 | 5 | 22 | — | — | — | — | — | — | uniform, long and continuous thin wire | — |
| 4 | 35 | 23 | — | — | 15 | 15 | 2 | 10 | — | — | — | — | — | — | short wire (≦5 cm) | — |
| 5 | 80 | 3 | — | — | 2 | 2 | 5 | 8 | — | — | — | — | — | — | uniform, long and continuous thin wire | — |
| 6 | 69 | 10 | — | — | 5 | 5 | 1 | 10 | — | — | — | — | — | — | relatively long thin wire | — |
| 7 | 54 | 10 | — | — | 5 | 5 | 16 | 10 | — | — | — | — | — | — | uniform, long and continuous thin wire | — |
| 8 | 67.9995 | 10 | — | — | 5 | 5 | 2 | 10 | — | — | 0.0005 | — | — | — | " | — |
| 9 | 73.3 | 1 | — | — | 5 | 5 | 5 | 10 | — | — | 0.7 | — | — | — | relatively long thin wire | 1373 |
| 10 | 76.95 | 1 | — | — | 5 | 5 | 2 | 10 | — | — | — | — | — | 0.05 | uniform, long and continuous thin wire | — |
| 11 | 71 | 1 | — | — | 5 | 5 | 2 | 10 | — | — | — | — | — | 6 | relatively long thin wire | — |

TABLE 2

| Example | Crystal Grain Size (μm) | Wear ($10^{-4}$ mm$^3$) | Deflective Strength (kg/mm$^2$) | Corrosion Current (μA/mm$^2$) | hardness (kg/mm$^2$) |
|---|---|---|---|---|---|
| 1 | 0.8 | 18 | 405 | 2.4 | 720 |
| 2 | 0.8 | 21 | 410 | 2.8 | 690 |
| 3 | 0.8 | 25 | 415 | 2.5 | 640 |
| 4 | 1.5 | 12 | 401 | 1.7 | 1000 |
| 5 | 0.9 | 15 | 407 | 0.8 | 880 |
| 6 | 0.7 | 14 | 420 | 1.5 | 860 |
| 7 | 1.0 | 6.0 | 400 | 1.3 | 1200 |
| 8 | 2.0 | 10 | 405 | 1.9 | 1000 |
| 9 | 1.0 | 5.0 | 408 | 1.4 | 1110 |
| 10 | 2.0 | 7.0 | 410 | 1.4 | 1170 |
| 11 | 0.6 | 18 | 430 | 1.8 | 710 |
| 12 | 0.5 | 19 | 440 | 1.3 | 700 |
| 13 | 0.4 | 22 | 450 | 2.4 | 610 |
| 14 | 0.4 | 16 | 460 | 1.0 | 980 |
| 15 | 0.5 | 17 | 450 | 0.9 | 1040 |
| 16 | 0.7 | 17 | 430 | 3.1 | 770 |
| 17 | 0.6 | 15 | 429 | 3.5 | 800 |
| 18 | 0.3 | 17 | 490 | 3.5 | 790 |
| 19 | 0.3 | 15 | 460 | 2.8 | 990 |
| 20 | 1.0 | 8.5 | 481 | 52 | 670 |
| 21 | 0.8 | 13.6 | 434 | 29 | 980 |
| 22 | 1.0 | 7.1 | 430 | 70 | 1050 |
| 23 | 0.9 | 7.1 | 410 | 49 | 800 |
| 24 | 1.0 | 0.9 | not broke | 93 | 700 |
| 25 | 0.9 | 4.1 | not broke | 34 | 570 |
| 26 | 0.4 | 8.0 | not broke | 31 | 530 |
| 27 | 0.8 | 3.7 | not broke | 95 | 570 |
| 28 | 1.0 | 0.8 | 430 | 90 | 730 |
| 29 | 2.5 | 2.4 | 400 | 89 | 1170 |
| 30 | 1.0 | 5.5 | 458 | 32 | 750 |
| 31 | 1.0 | 5.3 | 449 | 30 | 740 |
| 32 | 0.9 | 1.8 | 466 | 98 | 760 |
| 33 | 1.0 | 3.2 | 426 | 61 | 920 |
| 34 | 4.0 | 3.3 | 402 | 84 | 805 |
| 35 | 0.5 | 7.5 | not broke | 24 | 760 |
| 36 | 0.8 | 4.4 | not broke | 85 | 640 |
| 37 | 0.5 | 3.0 | 493 | 33 | 890 |
| 38 | 0.4 | 2.6 | 510 | 29 | 900 |
| 39 | 1.0 | 0.8 | 436 | 87 | 725 |
| 40 | 0.9 | 2.7 | not broke | 91 | 590 |
| 41 | 1.0 | 6.2 | not broke | 79 | 580 |
| 42 | 0.8 | 3.5 | 484 | 83 | 670 |
| 43 | 0.9 | 3.0 | 461 | 30 | 800 |
| 44 | 0.9 | 2.7 | 455 | 28 | 810 |

TABLE 2-continued

| | | | | | |
|---|---|---|---|---|---|
| 45 | 0.8 | 2.4 | 458 | 82 | 690 |
| 46 | 0.8 | 2.0 | 485 | 76 | 700 |
| 47 | 0.4 | 16 | 460 | 1.2 | 820 |
| 48 | 0.9 | 3.0 | 450 | 60 | 910 |
| 49 | 0.5 | 2.0 | 505 | 55 | 1030 |

| Comparative Example | Crystal Grain Size (μm) | Wear ($10^{-4}$ mm$^3$) | Deflective Strength (kg/mm$^2$) | Corrosion Current (μA/mm$^2$) | hardness (kg/mm$^2$) |
|---|---|---|---|---|---|
| 1 | coarse dendrite | 70.6 | 350 | 31 | 605 |
| 2 | dendrite | 50 | 375 | 1.2 | 800 |
| 3 | 6.0 | 2.0 | 170 | 6.4 | 1360 |
| 4 | non-uniform and coarse | 11 | 190 | 2.0 | 1190 |
| 5 | coarse dendrite | 60 | 413 | 4.5 | 520 |
| 6 | coarse dendrite | 30 | 355 | 3.2 | 645 |
| 7 | 6.0 | 5.1 | 360 | 2.1 | 1250 |
| 8 | 0.8 | 19 | 405 | 2.2 | 720 |
| 9 | 1.1 | 10 | 310 | 29 | 490 |
| 10 | 0.8 | 24 | 420 | 2.8 | 670 |
| 11 | 1.0 | 12 | 350 | 8.8 | 1010 |
| Stainless Steel Wire | — | 104 | not broke | 6.4 | 600 |
| Piano Wire | — | 67 | not broke | 4500 | 630 |
| Elgiloy alloy wire | — | 50 | 400 | 1.0 | 650 |
| Powdered high-speed steel wire | — | 5.0 | 450 | 2500 | 850 |
| Hard metal wire | — | 0.2 | 350 | 1000 | 1100 |

The data of wear, deflective strength, corrosion current and hardness noted in Table 2 were obtained by the following test procedures.

(1) Wear

The outer surface of a thin wire was polished to a diameter of 0.2 mm and one of its ends was brought vertically into contact with the surface of a polyester film (Microtrace® of Kimoto Co., Ltd.), which was caused to run a distance of 180 m at a rate of 5 cm/sec under a load of 70 g/mm$^2$. The volume of resulting wear at the wire end was measured.

(2) Deflective strength

A thin wire with a diameter of 0.25 mm was placed between two supports that were spaced apart by a distance of 7 mm. The wire was pushed down at a rate of 50 g/sec with a plunger (0.2$^R$) that was applied to the center of the wire equidistant from each support. The maximum load at which the wire broke was measured and recorded as its deflective strength.

(3) Corrosion current

A thin wire was immersed in an aqueous solution of 5% $H_2So_4$ (25° C.) and potential scanning was conducted with a potentiostat over the range of −500 mV to +500 mV (SCE as a reference electrode) at a rate of 50 mV/min. The maximum current generated was measured and recorded as the corrosion current.

(4) Hardness

The hardness of a thin wire under a load of 500 g as measured with a Micro-Vickers hardness tester.

As Table 2 shows, the thin metal wires prepared according to the present invention had high wear resistance (wear of $25\times10^{-4}$ mm$^3$ or less), high resistance to bending (deflective strength of 400 kg/mm$^2$ or more), and high corrosion resistance (corrosion current of 100 μA/mm$^2$ or less). In addition, it can be seen that such superior thin wires can be obtained from molten alloys in one stage. In other words, the present invention enables thin metal wires of superior performance to be produced at low cost. Therefore, the thin metal wires of the present invention are useful not only as engineering parts but also as consumables in a broad range of applications such as industrial, household and recreational uses.

What is claimed is:

1. A fine crystalline thin wire of a cobalt base alloy having a composition of the formula:

$$Co_kM_lB_mSi_n$$

where Co is cobalt; M is at least one of the transition metals of groups IV, V and VI of the periodic table; B is boron; Si is silicon; k, l, m and n represent atom percent of Co, M, B and Si, respectively, and have the following values:

k=40–78
l=10–50
m=2–15
n=8–20

$m+n=13-35$ and the thin wire being formed by an in-liquid rapid quenching and solidification melt spinning method and the fine crystal grains in the thin wire having an average size of no more than 5 μm.

2. A thin wire according to claim 1 wherein the total content of cobalt as combined with titanium, vanadium and/or chromium is no more than 80 atom percent.

3. A thin wire according to claim 1 or 2, further containing at least one rare earth metal in an amount of 0.001–0.5 atom percent.

4. A thin wire according to claim 1 or 2, further containing 0.1–5.0 atom percent of carbon.

5. A thin wire according to claim 1 or 2, further containing 0.001–0.5 atom percent of at least one rare earth metal and 0.1–5.0 atom percent of carbon.

6. A process for producing a fine crystalline thin wire of a cobalt base alloy, comprising the steps of:

thermally melting an alloy having a composition of the formula:

$$Co_kM_lB_mSi_n$$

where Co is cobalt; M is at least one of the transition metals of groups IV, V and VI of the periodic table; B is boron; Si is silicon; k, l, m and n represent atom percent of Co, M, B, Si, respectively, and have the following values:

$k=40-78$
$l=10-50$
$m=2-15$
$n=8-20$; and jetting the molten alloy through a spinning nozzle into a liquid layer of an aqueous solution containing a carbonate formed within a rotating drum by centrifugal force while rapidly quenching the spun filaments to solidify at a cooling rate of $10^4-10^6$ K./sec so that a thin wire having crystal grains of no more than 5 μm in average size is formed in one stage.

7. A process according to claim 6 wherein the starting alloy further contains at least one rare earth metal in an amount of 0.001–0.5 atom percent.

8. A process according to claim 6 wherein the starting alloy further contains 0.1–5.0 atom percent of carbon.

9. A process according to claim 6 wherein the starting alloy further contains 0.001–0.5 atom percent of at least one rare earth metal and 0.1–5.0 atom percent of carbon.

10. A process according to claim 6, 7, 8 or 9 wherein the thin wire formed by rapid quenching and solidification is heat-treated at a temperature in the range of 800–1,600 K.

11. A thin wire according to claim 1, wherein the in-liquid rapid quenching and solidification melt spinning method is an in-rotating-liquid spinning method.

12. A thin wire according to claim 1, wherein the method is a spinning method of jetting into a fluid stream.

13. A fine crystalline thin wire of a cobalt base alloy having a composition of the formula:

$$Co_kM_lB_mSi_n$$

where Co is cobalt, M is at least one of the transition metals of groups IV, V and VI of the periodic table; B is boron, Si is silicon, k, l, m and n represent atom percent of Co, M, B and Si, respectively, and have the following values:

$k=40-78$
$l=10-50$
$m=2-15$
$n=8-20$
$m+n=13-35$ and the thin wire being formed by a rapid quenching and solidification melt spinning method and the fine crystal grains in the thin wire having an average size of no more than 5 μm.

* * * * *